US005101842A

United States Patent [19]

Ehmann

[11] Patent Number: 5,101,842

[45] Date of Patent: Apr. 7, 1992

[54] METHOD FOR CURLING HAIR USING SPRING CLIP

[76] Inventor: Josefine Ehmann, Friedrichstrasse 8a, 6900 Heidelberg, Fed. Rep. of Germany

[21] Appl. No.: 693,071

[22] Filed: Apr. 29, 1991

Related U.S. Application Data

[63] Continuation of Ser. No. 320,854, Mar. 8, 1989, abandoned, which is a continuation of Ser. No. 158,560, Feb. 22, 1988, abandoned.

[51] Int. Cl.[5] ..... A45D 7/00

[52] U.S. Cl. ..... 132/210; 132/277; 132/263

[58] Field of Search ..... 132/210, 276, 277, 242, 132/263, 231, 251, 249, 252, 259, 260, 254, 255, 264

[56] References Cited

U.S. PATENT DOCUMENTS

| | | | |
|---|---|---|---|
| 38,437 | 5/1863 | Wiard et al. | 24/507 X |
| D. 50,981 | 7/1917 | Creech et al. | D28/39 |
| 367,371 | 8/1887 | Cushing | 24/507 X |
| 854,901 | 5/1907 | Mooers | 132/277 |
| 900,034 | 9/1908 | Newton | 24/507 |
| 1,187,285 | 6/1916 | Dreyer | 132/277 |
| 1,677,109 | 7/1928 | Korper | 24/507 |
| 1,690,937 | 11/1928 | Larm | 132/251 |
| 2,289,749 | 7/1942 | Boxer | 132/276 |
| 2,599,321 | 6/1952 | Doran | 24/510 |
| 2,749,921 | 6/1956 | Caponette | 132/242 |
| 2,849,008 | 8/1958 | Otten | 132/277 |
| 3,057,366 | 10/1962 | Fink | 132/277 |
| 4,624,272 | 11/1986 | Franzino | 132/251 |

FOREIGN PATENT DOCUMENTS

| | | | |
|---|---|---|---|
| 463125 | 6/1935 | United Kingdom | 24/507 |

*Primary Examiner*—John J. Wilson
*Assistant Examiner*—Jeffrey A. Smith
*Attorney, Agent, or Firm*—Wegner, Cantor, Mueller & Player

[57] ABSTRACT

A method for curling hair on the scalp of a user is described. The steps include winding a plurality of strands of hair around a finger or pin to form a coil, and retaining the hair in its wound state with a spring action clip. the clip has two bars arranged next to each other connected by a spring which biases the two bars naturally closed. Spheres are provided at free ends of the bars which contact each other in the closed state and provide an interstice between the bars allowing the strands of hair to be held lossely when a retaining part of one of the bars extends through the coil of hair.

3 Claims, 2 Drawing Sheets

METHOD FOR CURLING HAIR USING SPRING CLIP

This application is a continuation of U.S. application Ser. No. 07/320,854, field Mar. 8, 1989, and now abandoned, which is a continuation of U.S. application Ser. No. 07/158,560, filed Feb. 22, 1988, and now abandoned.

The invention concerns a spring-action clamp, composed of two bars arranged next to one another, connected together with a spring between them, in such a way as to pivot around a point of rotation that divides each bar into two lever arms; in which arrangement, in the relaxed condition of the spring, two lever arms of the bars, arranged next to one another, are angled outward and can be pressed together in a spring action, thus spreading apart the other two lever arms that form the clamping parts.

Clamps of this kind are particularly familiar as clothespins, but also as so-called clips in hairdressing, which clamps serve to pin down various rollers or curled strands of hair. Here a strand of hair rolled around a roller, or simply a rolled loose strand, is held down by the clamp or clip. It can easily be seen that in this way the rolled strands of hair are compressed at the point gripped by the clamping parts, and the hair is crimped.

The task of the invention is to create a spring-action clamp of the type mentioned at the start, which among other purposes may also particularly be used in hairdressing, to hold rolled strands of hair without the risk of compressing and thus crimping parts of the rolled strand.

This task is accomplished in a spring-action clamp of the type mentioned at the start, in that the two lever arms forming the clamping parts are spaced apart essentially parallel to one another, and on the free end of each of these lever arms is arranged a sphere of rubber or a rubber-like plastic, and the spheres come into contact with one another when the clamp is biased by the spring to the closed state.

It is useful if each sphere is applied radially to the end of the lever arms.

Such a spring-action clamp may be used in hairdressing, in particular to hold merely curled strands of hair—i.e., strands not rolled on rollers. The strand of hair, for example twisted around a pin or finger, is slipped off the pin or finger and essentially laid radially on the head. The clamp or clip is then applied from above with its clamping parts open, so that at one point the hairs of the strand are placed in the interstice between the lever arms of the clamping parts and the spheres sit on the head. The clamp or clip thus stands essentially radially on the head and the spheres press lightly against the scalp, as shown in FIG. 3. In this way, the hairs of the strand held in the interstice between the lever arms of the clamping parts lie loosely, and are held sufficiently firmly by the seating of the clamp or clip on the scalp, without being compressed. The hair thus treated falls in soft, natural-acting waves.

The invention will be explained in further detail from an embodiment shown in the drawings.

DESCRIPTION OF THE PREFERRED EMBODIMENTS

Figure 1:
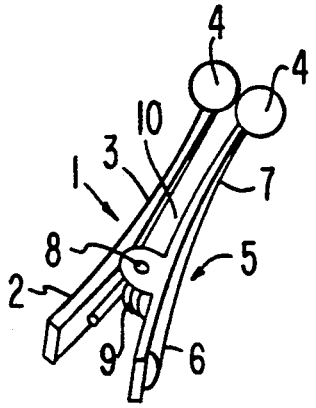
FIG. 1 shows view in perspective of a spring-action clamp in its closed state.
Figure 2:
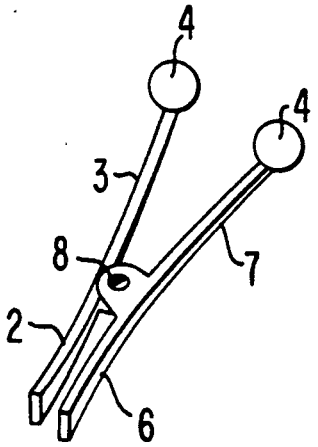
FIG. 2 shows a view in perspective of the clamp in its operative condition.
Figure 3:
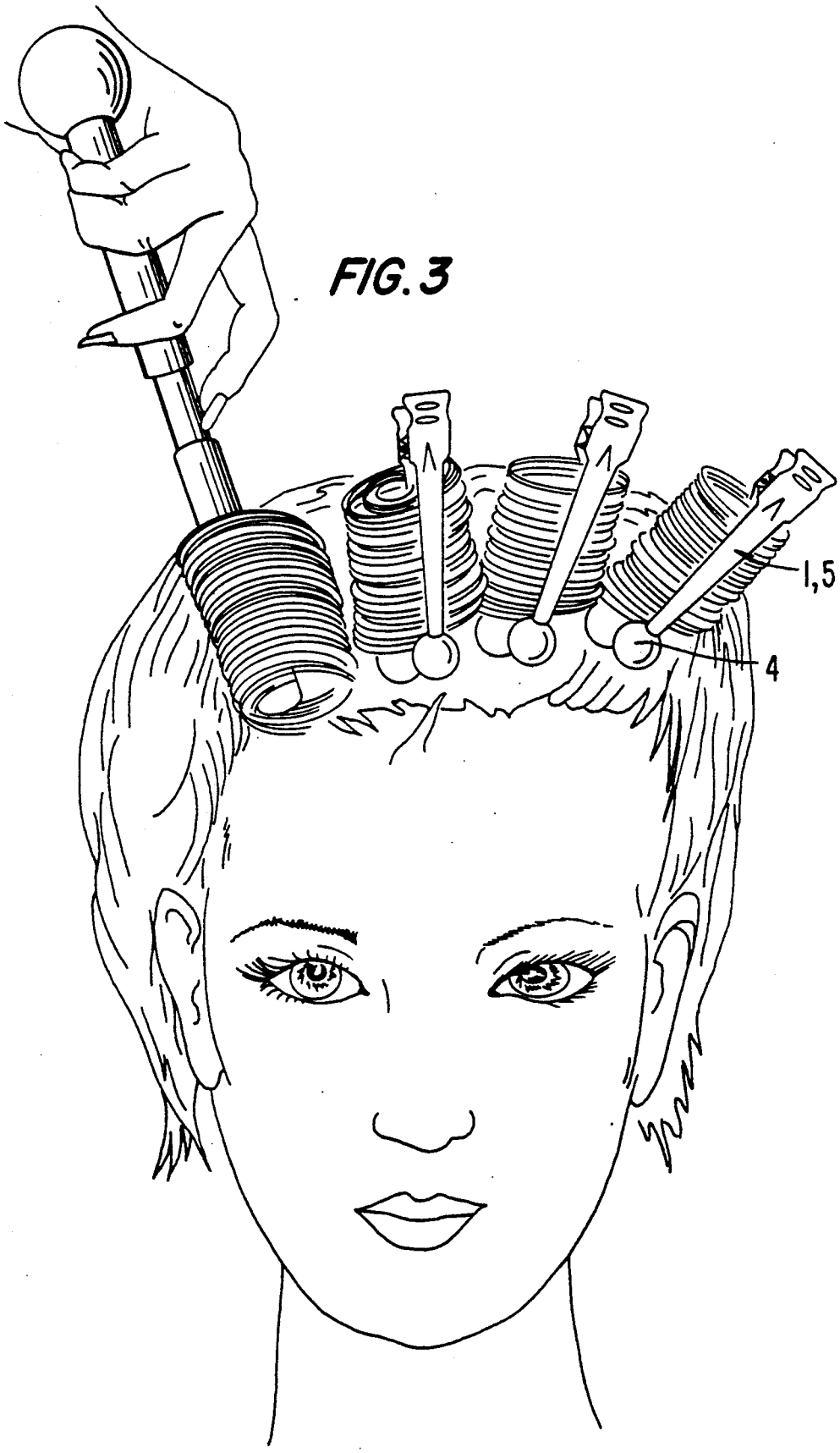
FIG. 3 shows a front perspective view of a user employing the method as claimed.

The spring-action clamp under the invention is composed of two bars 1 and 5 arranged next to one another, connected together with a spring 9 between them, in such a way as to pivot around a point of rotation 8.

This point of rotation 8 divides each bar 1 and 5 into two lever arms 2 and 3, and, 6 and 7 respectively. Two of the lever arms 2 and 6 arranged next to one another are angled slightly outward from the connection point between bars 1 and 5, formed by the point of rotation 8. Thus these two lever arms 2 and 6 can be moved toward each other along a sufficiently long path, thereby spreading in a scissors motion the other two lever arms 3 and 7 of the bars 1 and 5, which form the clamping parts.

The spreadable lever arms 3 and 7 of bars 1 and 5 are essentially parallel to one another, but there is an appropriate distance between them and the interstice 10 thus formed serves to receive the hair of the rolled strand. These two lever arms 3 and 7 are part of the clamp's clamping parts, but the actual clamping action is produced by spheres 4 arranged on the free ends of the lever arms 3 and 7. These spheres 4 come into contact with one another when the clamp is in its closed state, i.e., the spring 9 is relaxed. Preferably each sphere 4 is applied radially to the end of the lever arms 3 and 7 respectively. The contacting spheres 4 close the interstice 10 between the lever arms 3 and 7 and thus create a fully enclosed space for the hair strand that is to be held.

When the diverging lever arms 2 and 6 are pressed together, the other lever arms 3 and 7 with the spheres 4 are moved apart in a scissors motion. The clamp, opened in this way, can easily be applied from the top to some point of the rolled strand of hair. The spheres 4 of the closed clamp sit on the scalp and hold the clamp radially in position, and furthermore ensure maintenance of the distance between the parallel lever arms 3 and 7 of the bars 1 and 5.

The clamp under the invention may of course be used anywhere that two or more parts are to be releasably connected to each other.

I claim:

1. A method for curling hair on the scalp of a user, comprising:

winding a plurality of strands of hair around a finger or pin to form a coil of hair;

retaining the hair in its wound state with a spring action clip, said clip comprising:

two bars arranged next to each other;

a spring which connects said bars and allows them to pivot about an axis of rotation between a closed state and an open state, the axis of rotation dividing each bar into a first lever arm and a second lever arm, wherein said spring biases the bars toward the closed state, the first lever arms of the two bars extending away from each other in the closed state and are pressable together against the biasing force of the spring so as to bring the bars into the open state, the second lever arms of the two bars are spread apart when the bars are in the open state, and the second lever arms extend essentially parallel to each other so as to form an elongated interspace when the bars are in the closed position, said second lever arms forming retaining parts; and a sphere made of rubber or plastic attached to a free end of each of the second lever arms, said spheres extending past the free end of the second lever arms, and contacting each other when the bars are in the closed state;

wherein said clip is biased closed so that said two bars extend essentially radially from the scalp of the user with one of said arms extending through the coil of hair, the strands of hair are loosely held in said interspace between the second lever arms, and said spheres contact the scalp.

2. The method as claimed in claim 1, wherein said second lever arms each have a longitudinal axis, and the spheres are connected to the second lever arms so that the centers of the spheres lie on the longitudinal axes of the second lever arms.

3. A method for curling hair on the scalp of a user, comprising:

winding a plurality of strands of hair around a finger or pin;

retaining the hair in its wound state with a spring action clip, said clip comprising:

two bars arranged next to each other;

a spring which connects said bars and allows them to pivot about an axis of rotation between a closed state and an open state, the axis of rotation dividing each bar into a first lever arm and a second lever arm, wherein said spring biases the bars toward the closed state, the first lever arms of the two bars extending away from each other in the closed state and are pressable together against the biasing force of the spring so as to bring the bars into the open state, the second lever arms of the two bars are spread apart when the bars are in the open state, said second lever arms forming retaining parts; and a sphere made of rubber or plastic attached to a free end of each of the second lever arms, said spheres extending past the free end of the second lever arms, and contacting each other when the bars are in the closed state, said spheres having a diameter sufficient that said second lever arms are maintained essentially parallel to each other when the bars are in their closed state so as to form an elongated interspace between said second lever arms;

wherein said clip is biased closed so that said two bars extend essentially radially from the scalp of the user, the strands of hair are loosely held in said interspace between the second lever arms, and said spheres contact the scalp.

* * * * *